US007789273B2

(12) United States Patent
Kadyk et al.

(10) Patent No.: US 7,789,273 B2
(45) Date of Patent: Sep. 7, 2010

(54) COMPONENT MIXING METHOD, APPARATUS AND SYSTEM

(75) Inventors: Jeffery Kadyk, Sherman, IL (US); Suresh Radhakrishnan, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 564 days.

(21) Appl. No.: 11/571,222

(22) PCT Filed: Jun. 23, 2005

(86) PCT No.: PCT/US2005/022648

§ 371 (c)(1),
(2), (4) Date: Jan. 25, 2007

(87) PCT Pub. No.: WO2006/019523

PCT Pub. Date: Feb. 23, 2006

(65) Prior Publication Data

US 2008/0049548 A1 Feb. 28, 2008

Related U.S. Application Data

(60) Provisional application No. 60/583,153, filed on Jun. 25, 2004, provisional application No. 60/617,106, filed on Oct. 8, 2004.

(51) Int. Cl.
*B67D 7/78* (2010.01)

(52) U.S. Cl. ..... 222/145.5; 222/129.1; 366/162.4; 366/173.1; 99/323.3

(58) Field of Classification Search ... 222/129.1–129.4, 222/145.1, 145.5–145.6; 99/293, 323.3; 366/137.1, 162.4, 167.1, 173.1
See application file for complete search history.

(56) References Cited

U.S. PATENT DOCUMENTS 1,409,827 A 3/1922 Callahan (Continued)

FOREIGN PATENT DOCUMENTS

EP 1380536 1/2004

(Continued)

OTHER PUBLICATIONS

International Search Report issued in PCT/US05/022648 (2006).

(Continued)

*Primary Examiner*—Kevin P Shaver
*Assistant Examiner*—Andrew P Bainbridge
(74) *Attorney, Agent, or Firm*—Barnes & Thornburg LLP

(57) ABSTRACT

A mixing device and method for mixing at least one first ingredient and at least one second ingredient. The device includes a body which has a wall defining a cavity. A first inlet communicates with the cavity for introducing the first ingredient and a second inlet communicates with the cavity for introducing the second ingredient. An outlet is provided in communication with the cavity receiving the mixed first and second ingredient which have been mixed in the cavity. The ingredients are mixed by introducing one ingredient as a stream and the second ingredient as a forcefully introduced stream. An area upstream of the ingredients is provided for mixing ingredients. Once mixed the ingredients must flow through the body before reaching the outlet. The device can be in the form of a kit for retrofitting on existing devices such as beverage dispensers.

19 Claims, 14 Drawing Sheets

U.S. PATENT DOCUMENTS

| | | | | |
|---|---|---|---|---|
| 2,905,448 | A * | 9/1959 | Martinek | 366/147 |
| 2,986,306 | A | 5/1961 | Cocanour | |
| 3,460,717 | A | 8/1969 | Thomas | |
| 3,868,967 | A | 3/1975 | Harding | |
| 3,884,388 | A | 5/1975 | Holcomb | |
| 3,985,269 | A | 10/1976 | Bardeau et al. | |
| 4,148,334 | A | 4/1979 | Richards | |
| 4,168,018 | A | 9/1979 | Zahaykevich | |
| 4,173,296 | A | 11/1979 | Marshall | |
| 4,194,650 | A | 3/1980 | Nottke et al. | |
| 4,407,431 | A | 10/1983 | Hutter, III | |
| 4,440,318 | A | 4/1984 | Berger | |
| 4,547,128 | A | 10/1985 | Hayes | |
| 4,676,401 | A | 6/1987 | Fox et al. | |
| 4,753,370 | A | 6/1988 | Rudick | |
| 4,808,346 | A * | 2/1989 | Strenger | 261/18.1 |
| 4,842,166 | A * | 6/1989 | van Zijverden | 222/129.2 |
| 5,000,352 | A | 3/1991 | Cleland | |
| 5,033,651 | A | 7/1991 | Whigham et al. | |
| 5,058,768 | A | 10/1991 | Lichfield | |
| 5,114,047 | A | 5/1992 | Baron et al. | |
| 5,238,154 | A * | 8/1993 | Zuriel | 222/189.06 |
| 5,263,613 | A | 11/1993 | Billings | |
| 5,269,442 | A * | 12/1993 | Vogel | 222/129.1 |
| 5,492,655 | A | 2/1996 | Morton et al. | |
| 5,570,822 | A * | 11/1996 | LeMarbe et al. | 222/459 |
| 5,685,639 | A | 11/1997 | Green | |
| 5,803,320 | A | 9/1998 | Cutting et al. | |
| 5,839,610 | A | 11/1998 | Reese et al. | |
| 5,967,367 | A | 10/1999 | Orsborn | |
| 6,173,862 | B1 * | 1/2001 | Buca et al. | 222/1 |
| 6,183,341 | B1 | 2/2001 | Melcer | |
| 6,193,109 | B1 | 2/2001 | Credle et al. | |
| 6,196,016 | B1 | 3/2001 | Knowles et al. | |
| 6,202,894 | B1 | 3/2001 | Struminski | |
| 6,253,963 | B1 * | 7/2001 | Tachibana | 222/129.1 |
| 6,286,549 | B1 | 9/2001 | Carse et al. | |
| 6,382,464 | B1 | 5/2002 | Uzawa | |
| 6,669,053 | B1 | 12/2003 | Garson et al. | |
| 6,820,763 | B2 | 11/2004 | Bilskie et al. | |
| 6,840,462 | B2 | 1/2005 | Hurray et al. | |
| 6,871,761 | B2 | 3/2005 | Fox | |
| 6,915,926 | B2 | 7/2005 | Naik | |
| 6,994,231 | B2 | 2/2006 | Jones | |
| 7,048,148 | B2 | 5/2006 | Roekens et al. | |
| 7,077,290 | B2 | 7/2006 | Bethuy et al. | |
| 7,108,156 | B2 | 9/2006 | Fox | |
| 7,147,131 | B2 | 12/2006 | Sher et al. | |
| 2002/0023935 | A1 | 2/2002 | Heyes | |
| 2002/0130140 | A1 | 9/2002 | Cote | |
| 2004/0026451 | A1 | 2/2004 | Jones | |
| 2004/0083899 | A1 | 5/2004 | Nilsson | |
| 2004/0099688 | A1 | 5/2004 | Davis | |
| 2005/0284885 | A1 | 12/2005 | Kadyk et al. | |

FOREIGN PATENT DOCUMENTS

| | | |
|---|---|---|
| EP | 1634640 | 3/2006 |
| WO | WO 02/49458 | 6/2002 |

OTHER PUBLICATIONS

International Search Report issued in PCT/US08/53380 (2008).
European Search Report issued in application No. EP 05772922 (2008).

* cited by examiner

COMPONENT MIXING METHOD, APPARATUS AND SYSTEM

CROSS-REFERENCE TO RELATED PATENT APPLICATIONS

This patent application is a U.S. Nationalization of international patent application no. PCT/US2005/022648, filed Jun. 23, 2005, which claims priority under 35 U.S.C. §119(e) to U.S. Provisional Patent Application No. 60/583,153, filed Jun. 25, 2004, and U.S. Provisional Patent Application No. 60/617,106, filed Oct. 8, 2004, all of which applications are expressly incorporated herein by reference in their entirety.

BACKGROUND

In the food preparation industry, it is important to mix ingredients to achieve an interim or final product. Prior mixing devices include passive, as well as active, mixing devices. Examples of passive mixing devices are devices which, by way of example, but not limitation, introduce beverage concentrate flowing into a stream of diluent, such as water. In some situations, this passive mixing may be acceptable depending on the type and nature of the concentrate as well as the diluent material, such as water.

An example of such a passive mixing device might be a venturi mixing apparatus in which two ingredients or components are brought together to produce a final mixed product. In a venturi device a stream of diluent, such as water, flows through a water feed line. Water flow is restricted and then expanded to produce a desired flow characteristic. On the expansion side of the venturi device is a connection to a second component. For example, the second component may be a beverage concentrate. The beverage concentrate connection or tube is connected to and communicates with the expansion side of the venturi device. When water flows through the water line and flows through the venturi device the venturi device creates a vacuum on the second component line thereby drawing second component from its source or container.

Another example of a passive mixing device occurs in the beverage industry in which concentrate is mixed with water by use of two separate lines and corresponding controllable valves. For example, the controllable valves are operated to allow the diluent, such as water, to be dispensed and a second component, such as a beverage concentrate, to be dispensed into the water stream. The water and beverage concentrate can be pumped to the valve, pressurized, fed by gravity or otherwise delivered to the corresponding valve. When the valves are activated, the ingredients or components come together for mixing in a passive manner. The combined stream produces some degree of turbulence thereby mixing or at least combining the components.

Examples of active mixing may include dispensing ingredients into a conical mixing chamber that may include rotating blades or other agitators. While mechanical mixing is essential in some situations, it requires additional time and effort to periodically cleanse the mechanical mixing components. Additionally, the use of mechanical mixing components results in a more complex and, possibly, more expensive system. Further, the use of mechanical mixing or active mixing components often requires a cleansing cycle. The clean-out cycle often involves rinsing the system with the diluent at the end of a dispensing cycle. The dispensing of the diluent such as water at the end of a dispense cycle may not be preferred because it adds a very diluted juice on the top of the cup. This may appear to the consumer as an improperly mixed solution or over diluted solution. In some situations the user or consumer of the product may find this rinsing unattractive or question whether their product is being over diluted or improperly diluted or watered-down.

In situations where passive mixing may be preferable for a variety of reasons, it is also important to make sure that the desired mixing results are achieved. Recently, in the area of beverage concentrates, the trend by the concentrate manufacturers is to increase the viscosity of the concentrate material. For example, while concentrate to diluent ratios of 4:1 are common, beverage concentrate manufacturers are increasing ratios to 5:1 and beyond. This increase in concentrate viscosity requires new systems, methods and apparatus for mixing the concentrate with water.

Additional features will become apparent to those skilled in the art upon consideration of the following detailed description of drawings exemplifying the best mode as presently perceived.

BRIEF DESCRIPTION OF THE DRAWINGS

The description particularly refers to the accompanying figures in which.

DESCRIPTION

Figure 1:
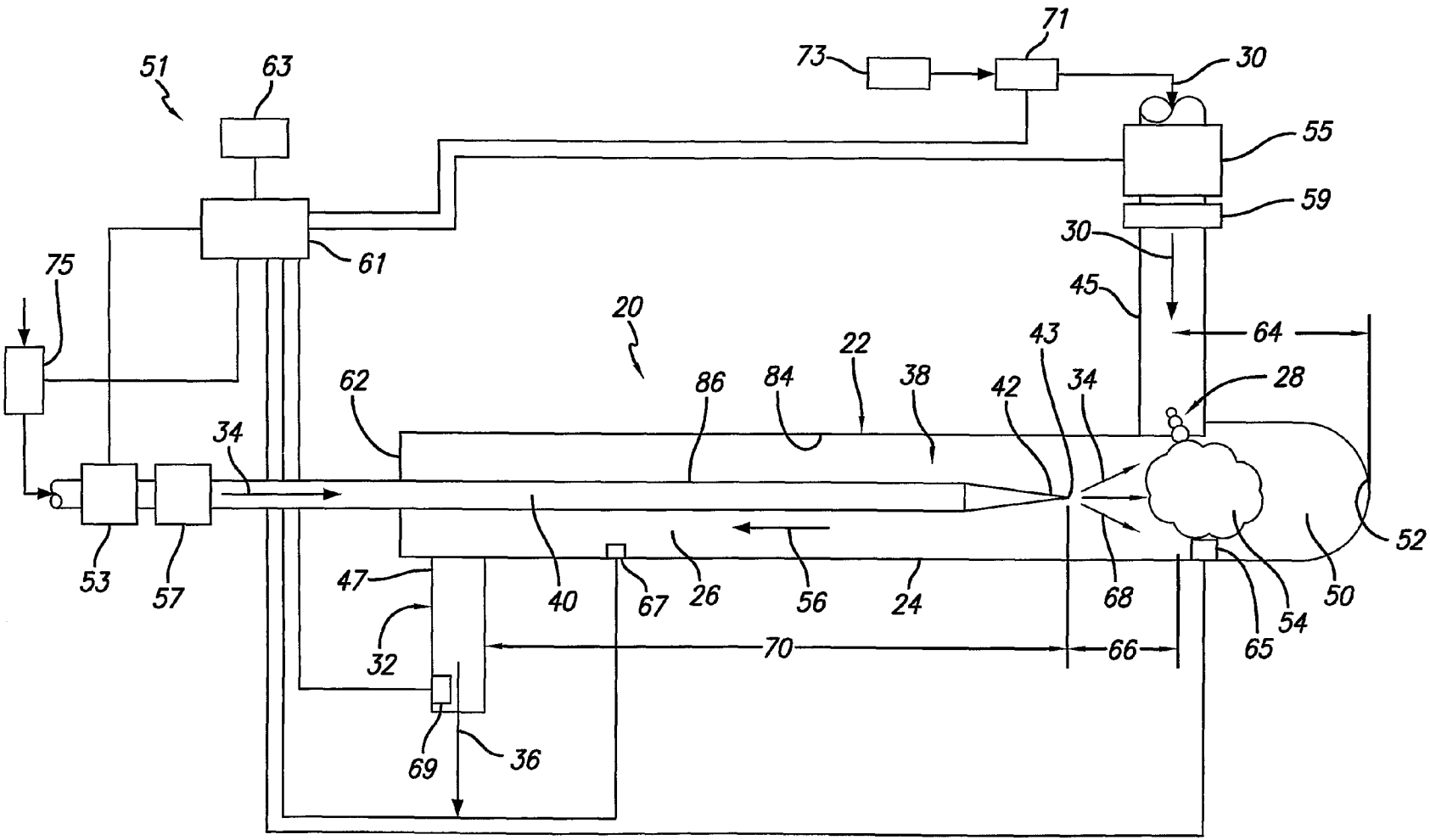
FIG. 1 is a diagrammatic illustration of a device for use in a system, method and apparatus to mix two ingredients to make a product, for example, mix beverage concentrate with water to produce a beverage.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

With reference to FIG. 1, one embodiment of a mixing device 20 is generally shown. The mixing device 20 is shown in diagrammatic form to present the general principles and structures associated with the system, method and apparatus used in the present disclosure. The mixing device includes a body 22 having at least one wall 24 generally defining a cavity 26. Reference to the body 22 and the wall 24 should be generally, broadly defined and interpreted. It is expected that a wide variety of body shapes, sizes and structures may be developed to achieve the device as set forth in this disclosure as well as improvements thereon and that the specific embodiments illustrated herein do not limit this disclosure. Additionally, reference to a wall should be broadly interpreted as being any particular structure whether solid or permeable, foraminous, slotted or any other structure including rigid, semi-rigid, flexible, articulated, or other characteristics which might be used to define the wall.

The body 22 includes a first inlet 28 communicating with the cavity 26 and through which at least one first ingredient, for example, juice concentrate 30 is dispensed into the cavity. An outlet 32 also communicates with the cavity 26 and is positioned spaced apart from the inlet 28. Concentrate 30 is introduced through the inlet 28 for mixing with a second ingredient, for example, water 34 which is introduced through a second or water delivery inlet 38. The concentrate 30 and water 34 flow into the chamber 26 for mixing therein.

Water 34 is introduced into the cavity 26 by a water delivery inlet 38. The inlet 38 includes a passage 40 defined in the illustration as a tube which has a dispensing end 42. The dispensing end 42 has at least one opening 43 through which water is dispensed. The opening 43 is positioned at or proximate to the dispensing end 42. The dispensing end 42 and at least one opening 43 are to be broadly interpreted and are not limited to the specific construction shown and described herein. The dispensing end 42 is positioned in the cavity 26 generally spaced between the inlet 28 and the outlet 32. Further, in at least one embodiment, the dispensing end 42 is positioned generally downstream of the inlet 28 and generally upstream of the outlet 32.

As used throughout, various terms are intended to be broadly interpreted. In this regard, the term "concentrate" is intended to be broadly interpreted as a second ingredient, which in one embodiment is a concentrate for beverages and other food substances including, by way of example, but not intended to be limited to, juice, tea, coffee, sugar-based beverages, dairy-based beverages, soda-fountain beverages, sports drinks, combinations of any beverages or beverage concentrates, as well as other food substances which might also benefit from the device, system and apparatus for mixing as disclosed herein. Similarly, the term "diluent" or "water" is intended to be broadly interpreted as a first ingredient which in one embodiment is water. While the present disclosure uses the term "water" and "diluent" generally interchangeably, it is anticipated that a variety of diluent materials may be used to produce a variety of beverage products. For example, diluent may be another ingredient such as another flavor or base ingredient other than water. Further, the diluent could be another form of ingredient such as, liquid gel, gas, ice crystals, or any other substance that is mixed with at least one other substance to produce the desired resultant product.

In at least one embodiment, a chamber 50 is defined within the cavity 26. The chamber 50 is generally positioned proximate to the inlet 28 and the dispensing end 42 of the water inlet 38. The chamber 50 is generally positioned spaced from and generally at least partially in opposition to the dispensing end 42 of the water inlet 38. The chamber 50 is positioned in any position to receive the first and second ingredients. As such, when water 34 is dispensed through the water inlet 38 and out through the end 42, water is directed toward the chamber 50. Also, the chamber 50 is generally positioned upstream of the flow out of the chamber 50 or generally out of the direct flow path of concentrate 30 flowing through the inlet 28. The position of the chamber 50 relative to the inlet 28 and dispensing end 42 results in some volume of concentrate 30 and water 34 being pushed or flowed into at least a portion of the chamber 50 for mixing within at least a portion of the chamber 50 before it is allowed to flow downstream toward the outlet 32.

The inlet 28, opening 43 of dispensing end 42 and the outlet 32 are shown in general diagrammatic form. For example, the inlet 28 and outlet 32 are generally shown as circular or otherwise tubular passages through which fluid can flow. Similarly, opening 43 of dispensing end 42 is shown as the reduced diameter tip of the tube at the dispensing end 42 of the delivery inlet 38. Each of these passages or tubes can be configured in any variety of forms to achieve a desired result. The diagrammatic embodiments are provided by way of illustration and are not intended to be limiting. For example, the opening associated with the inlet 28 and the outlet 32 may be in a flare outwardly or inwardly to produce a desired flow characteristic. For example, the concentrate entry point may be a reduced diameter relative to the diameter of the corresponding flow path 45 to change the flow characteristics of the concentrate 30 introduced into the device. Similarly, the outlet 32 may include an increased diameter opening in a corresponding tube 47 so as to facilitate draining, streamlining, columnating or otherwise making the fluid flow exiting the device flow in a predetermined manner, for example more cohesive or less cohesive. It is expected that these variations and other variations which are inspired by the present disclosure are within the scope of the present disclosure.

The present configuration of the device 20 prevents only a direct, gravity-induced fall of concentrate 30 and water 34 through the body 22 to the outlet 32. Rather, the flow action of the pressurized water from the dispensing end 42 directed toward the flow of concentrate 30 through the inlet 38 causes a driving or forcing of the water 34 and concentrate 30 into the chamber 50 for mixing. The pressurized water (a first ingredient) impinging on the concentrate (a second ingredient) causes mixing of the two ingredients in a manner not known in the prior art. This general concept applies to this disclosure regardless of the type and characteristics of the two or more ingredients mixed or the structure or orientation of the device used to mix the two or more ingredients. The force of the pressurized water impinging on the concentrate flow will cause the water and concentrate to mix. The chamber 50 has an end 52 which does not allow water and concentrate to flow there beyond. The directional flow of pressurized water 34 from the dispensing end 42 and the generally positively pressurized flow of concentrate 30 through the inlet 28 result in an accumulation of ingredients in the chamber 50. While it is mentioned that the flow of concentrate 30 through the inlet 28 is generally positively pressurized, it is expected that a gravity flow of concentrate 30 will also function in this application. The gravity flow also produces some degree of pressurization as a result of the influence of gravity on the concentrate flow and this embodiment is included in this disclosure.

Eventually, the accumulation in the chamber 50 is a volume which is greater than the volume of the chamber 50. This occurs when the pressure in the chamber exceeds the forces associated with the inlet flow of the pressurized water 34 from the dispensing end 42 and the inlet flow of the concentrate 30 through the inlet 28. At this point, a mixture 54 of concentrate and water will tend to flow 56 away from the chamber 50 and toward the outlet 32. The mixture 54 will continue to mix as it continues to flow 56 toward the outlet 32 whereupon it is dispensed as a generally integrated, homogeneous product, in this case a beverage 36.

The consistency of the beverage is a result of the physical agitation impact, or collision of the mixture 54 in the chamber 50 and flow 56 through the cavity 26. The mixture 54, once mixed in the chamber, is generally already homogeneous and fully dissolved, mixed or otherwise is a chemical combination of the at least two ingredients such as water and concentrate. This thorough mixing prevents separation, stratification or other settling or separation of the concentrate and water once it is dispensed from the outlet 32. As the volume of the chamber 50 is finite and water 34 and concentrate 30 continue to flow therein, the mixture 54 will tend to accumulate. The consistency of the beverage 36 may be, at least in part, due to the dissolution of the concentrate 30 into the water 34. This is in contrast to prior art mixing devices which merely may have combined the ingredients, yet not caused the concentrate 30 to dissolve, combine or otherwise transform into solution with the water 34 creating a generally homogeneous beverage 36.

The homogeneity of the beverage 36 can be tested by a Brix Scale measurement or Brix measurement. Preliminary tests show that the beverage 36 dispensed through the outlet 32 provides a consistent Brix measurement throughout different levels of a beverage volume dispensed into a container. Prior art devices may exhibit noticeably defined changes or variations in Brix measurements at different levels in the same container. In other words, the concentrate and the diluent or water are not thoroughly mixed or integrated. In contrast, the present mixing method and device causes the concentrate 30 to be thoroughly mixed in the water 34 creating a generally homogeneous beverage 36 as measured by the Brix measurements in a standard container. In contrast, the prior art devices dispensing beverage into the same container resulted in a change in the Brix measurement from the bottom of the container toward the top of the container. The variations in the Brix measurement are an indication that the beverage has not been thoroughly mixed and that, at least some portions of concentrate may not have been integrated or dissolved into the solution.

It should be noted that the various dimensions, shapes, proportions and relationships may be varied to some degree to achieve the same or similar results as generally described and disclosed herein. For example, while the general parameters of an inlet 28 communicating with the cavity 26 and an outlet 32 also communicating with the cavity 26 can be found in various embodiments, the generally horizontally, or at least partially horizontally, oriented configuration of these components will be used in various embodiments as well. Similarly, it is believed that the configuration of the chamber or holding area 50 providing a dead-end or cul-du-sac area in which water 34 and concentrate 30 collide and impinge upon each other to cause mixing is found in other configurations based on the concepts taught herein.

The flow of water and concentrate into the body 22 can be accurately controlled for controlled mixing by use of mixing control components 51. The mixing control components are to be broadly interpreted but may include, by way of example and not limitation, such components as a controllable inlet valve 53 on the water line and a controllable inlet valve 55 on the concentrate line. Further, a flow regulator 57 may be used on the water inlet line and a flow regulator 59 may be provided on the concentrate inlet line. The controllable valves 53,55 may be coupled to a controller 61 having a control panel, switch or other control device 63 also coupled to the controller. Additionally, pumping devices 71,75 or other flow pressurizing or accelerating devices may be coupled to the controller 61 for further control of the components. These flow control components 57 help to achieve the required or preferred mix of concentrate and water.

These components 51 can be actively controlled to modify the flow and dispensing of water and concentrate into the body 22. In this regard, one or more mixture sensors or detectors 65, 67, 69 may be positioned in the device or proximate to the device as necessary for detecting one or more of the concentration, Brix, specific gravity, conductivity or other measurable characteristics of the mixture at one or more locations to provide information to the controller 61. The sensors provide information which can be used by the controller to modify the operation of the components such as the control valves 53,55, pumps or other devices which are controllable and may have an effect on the resultant product 36. For example, if the concentration or other characteristics of the mixture as sensed by the sensors indicates that more concentrate is needed, the controllable valve 55 may be opened to allow more concentrate to flow. Alternatively, the pump 71 coupled to the controller 61 may be operated to increase the pumping rate to deliver more concentrate 30 from the ingredient or concentrate source 73. Similarly, the rate of pumping of a pump 75 communicating with the inlet line and coupled to the controller 61 may be reduced so as to reduce the quantity of water flowing into the inlet line.

It should be noted that the system as described above may include all of the aforementioned additional components or none of the components. In its simplest embodiment the device 20 includes the inlet line 38, inlet line 45 and body 22. The water inlet line 38 is a second ingredient source, in this case water, coupled to a pressurized or gravity fed source and the concentrate is coupled to a pressurized or gravity fed source. Desired pressures are provided to produce the desired result. However, more complicated variations may be provided by combining the simplest form with one or more of the aforementioned components. It is also envisioned that other components may be added to various embodiments to provide additional control, sensing, quality or other characteristics of the resultant beverage.

In its simplest form, the device eliminates extra components, parts or structures used for mixing. In the more complicated form the device provides increased control and accuracy of mixing. The resultant beverage is produced consistently and is mixed properly to produce a desired end product.

It is anticipated that the general principles are covered hereunder as well as all the other various modifications and variations that can be conceived by one of ordinary skill in the art having been taught the principles herein. For example, the dispensing end 42 can be a nozzle to provide a defined flow configuration such as in the form of a fan, ring, point or any other dispensing end 42 and associated opening 43 or openings configuration. A variety of dispensing ends 42 may be used to achieve specific results depending on the mixing conditions and the components used in the mixing operation and the ingredients, such as concentrate 30 and water 34, used in the mixing method. The nozzle or dispensing end 42 generally creates an upstream flow having a flow generally directed into the chamber 50. In at least one configuration, the dispensing end or nozzle 42 is configured to provide a jet action of measurable force. In this embodiment, the flow of the water causes movement of the concentrate 30 dispensed through the inlet 28 into the chamber 50 for subsequent agitation and mixing to form the mixture 54.

It is also envisioned that a variety of configurations of the chamber 50 are included within the scope of this disclosure. While a generally tubular, rounded, dead-end configuration is provided for the chamber 50, it is envisioned that various cross-sections, end 52 configurations and other features may be incorporated into the chamber 50 to provide the desired mixing effect depending upon the specific conditions used in the mixing method. Similarly, the configuration of the body 22 defining the shape, volume and surface features of the cavity 26 is to be broadly interpreted to include various embodiments. Likewise, the configuration, angular orientation, size, dimension, flow rate and other characteristics associated with the inlet 28 and the outlet 32 are envisioned to be broadly interpreted.

Consistent with the broadening of the various terms and characteristics of the present device, method and system, the introduction of water through the inlet 38 is shown as being positioned towards an end 62 generally positioned opposite the chamber 50. The inlet 38 could be introduced into the cavity 26 through the body 22 at various portions along the wall 24. Also, the position of the nozzle 42 in the cavity 26 can be adjusted to produce desired mixing results. In this regard, the nozzle 42 can be positioned upwardly, downwardly or angled towards or angled away from the inlet 28. As will be described in greater detail below with regard to FIG. 4, an angled nozzle 42 is disclosed. Additionally, as further disclosed in FIGS. 5-8 and 9 variations of the external surface of the inlet 38 and use of multiple and directed nozzles 42 is disclosed. Also, the relative dimensions of the inlet 28 and the end of the chamber defined by dimension 64 may be adjusted to increase or decrease the relative volume of the chamber 50. Similarly, the dimension 66 defined between the inlet 28 and dispensing end 42 can be adjusted to produce the desired effect of the water flow 68 impinging upon the concentrate 30 to produce the mixture 54. Similarly, the dimension 70 of the outlet flow path 56 from the dispensing end 42 to the outlet 32 may be adjusted to increase the dimension 70 or decrease the dimension 70 as might be necessary in different configurations and mixing requirements.

Figure 2:
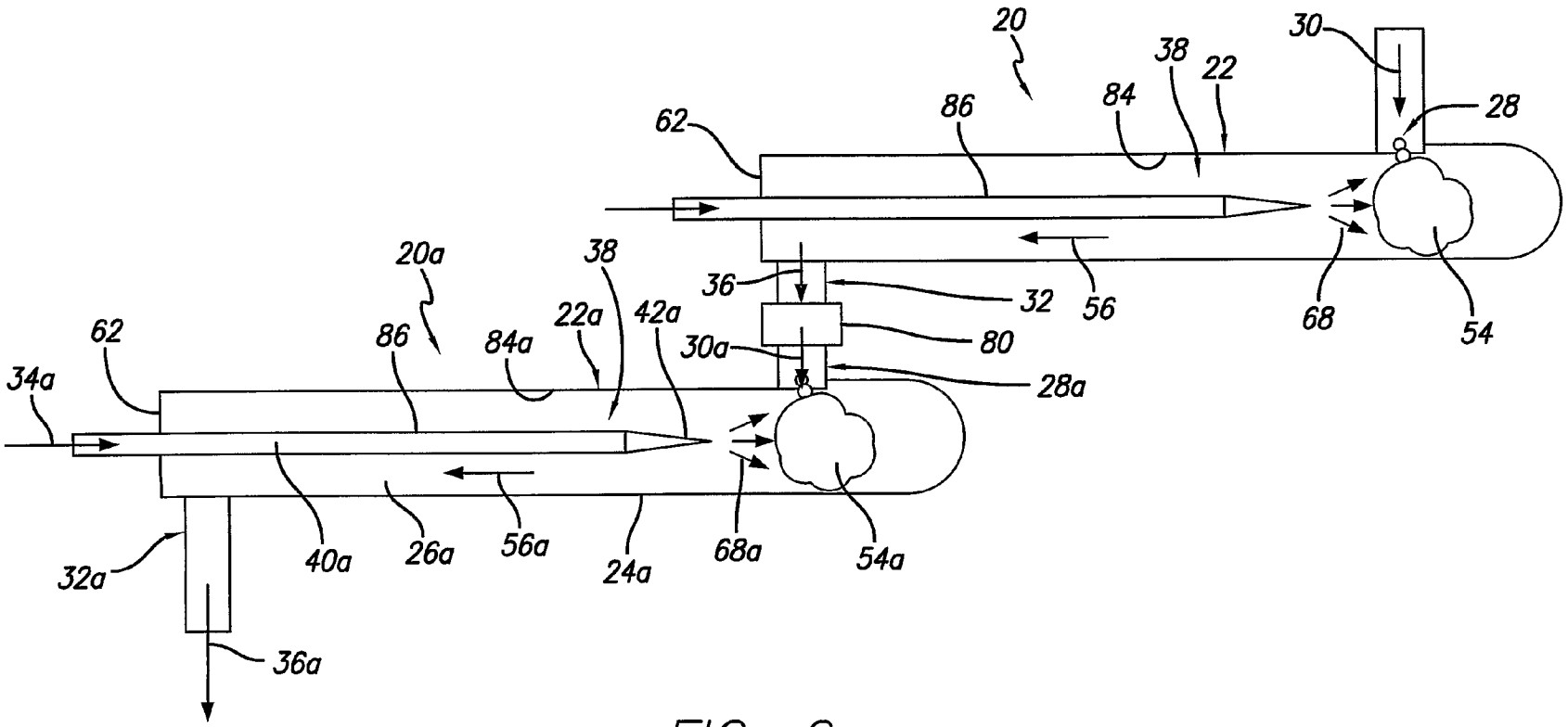
FIG. 2 is a diagrammatic illustration of a cascaded arrangement of two devices.

The mixing device of this disclosure can be configured in a cascading arrangement as shown in FIG. 2. In this regard, initial mixture 54 is combined from the inlet water 34 and concentrate 30. In a cascading arrangement the outlet 32 of one device 20 becomes the inlet 28*a* of a second device 20*a* positioned in a series or cascading configuration. In this configuration, the outlet 32 becomes the inlet 28*a* with the beverage mixture 36 becoming the concentrate 30*a*. Additional water 34*a* can be introduced to the concentrate 30*a* to produce a new mixture 54*a*. This can be done several times, if necessary, with water, other mixing ingredients. The system can also be used to introduce components or ingredients having different temperatures to achieve a desired result such as helping to dissolve or otherwise provide a chemical or mechanical advantage in mixing the components or ingredients. Also, another configuration of this embodiment may include a pump 80 or other device which adds energy to the beverage 36 from the first device 20 as it is dispensed to the second device 20*a*.

The cascading or serial configuration, with or without the pump 80, may be useful in situations in which a high density concentrate 30 may require mixing with water having an elevated temperature to produce a desired beverage or secondary concentrate result. It is envisioned that multiple cascading configurations which might have different characteristics can be used to produce a desired resultant beverage.

The present device also includes benefits with regard to concentrates which might include fibrous material. For example, some orange juice and other citrus juice concentrates may include relatively high levels of fibrous content or pulp. In prior art mixing devices, juice concentrate containing fibrous material may accumulate within the mixing device clogging the flow path in the system. In the present device, the surfaces are generally smooth and continuous allowing for easier, more efficient cleaning and sanitizing. In this regard, during a cleaning cycle, cleaning material could be introduced through the inlet 28 and agitated in the same maimer as when diluting a beverage concentrate. In this regard, the water 34 can be adjusted to a desired flow rate for mixing with sanitizing solution introduced through the inlet 28. The mixture then flows through the cavity 26 cleansing the interior surfaces of the cavity. The cleansing material flows through the outlet 32 for thorough cleaning of the mixing device.

Additionally, the device 20 can be configured to remove the body 22 to facilitate cleaning. This can be achieved in any one of many configurations which will allow disengagement of the body 22 from the dispensing device with which it may be used. If the body 22 is removable it can be placed into a sanitizing or dishwashing system to sanitize all the appropriate surfaces. Such a configuration may require a removable connection between the inlet passage 45 and the body 22 or may include a portion of the tube 45 and the outlet tube 47. It is anticipated that it may be preferable to allow one of the ends 52,62 to be removable so as to allow water to flush through the tube 22 defining the body. It is expected that many configurations can be developed which will allow the device to be removed from the machine for cleaning. Such developments might also include quick release connectors between the tube 47 and the tube 45, as well as a quick release between the water line 38 and the system. Further, it is envisioned that the body 22 could be separated at some location between the ends 52,62 to allow each portion to be placed into a cleaning or sanitizing system for thorough cleansing of the corresponding portions of the chamber 26.

In use, concentrate is introduced through the inlet 28 and impacted, collided with or otherwise impinged or impacted by pressurized water 34 flowing from the dispensing end 42. The water and concentrate 30 form a mixture 54 which backs up in a dead end chamber 50. The chamber 50 is positioned generally upstream from the outlet 32 and proximate to the inlet with the inlet 28 being positioned between the dispensing end 42 and the primary volume of the chamber 50. During the mixing method, the system and apparatus cause a volume of mixture 54 to back up in the chamber 50.

At a point when the volume and pressure created by the mixture 54 in the chamber 50 is greater than the flow rate of the flow path of water 68 flowing into the chamber 50, in combination with the volume and flow pressure of the juice concentrate 30 flowing therein, the mixture 54 tends to flow along the flow path 56 through the cavity 26. In this regard, the buildup of mixture 54 in the chamber 50 reaches a point where no additional mixture can accumulate in the chamber, the volume of the mixture 54 exceeds the volume of the chamber 50, and the mixture flows against the opposing flow 68 of water 34 from the water inlet 38. The mixture having the concentrate thoroughly combined in solution with the water flows through the outlet 32.

It is envisioned that the mixing device 20 as disclosed herein may also be provided as a kit for use with existing machines or to retrofit existing machines. In this kit, the device 20 can include a connection between the inlet tube 38 and the existing water line. Additionally, the inlet 28 can be coupled to an existing concentrate dispensing line. In this manner, the device 20 can be used with a variety of existing or yet to be designed beverage dispensers. The overall configuration of the device 20 can be adjusted or modified to accommodate the particular characteristics, inputs and desired outputs of the beverage dispenser.

Figure 3:
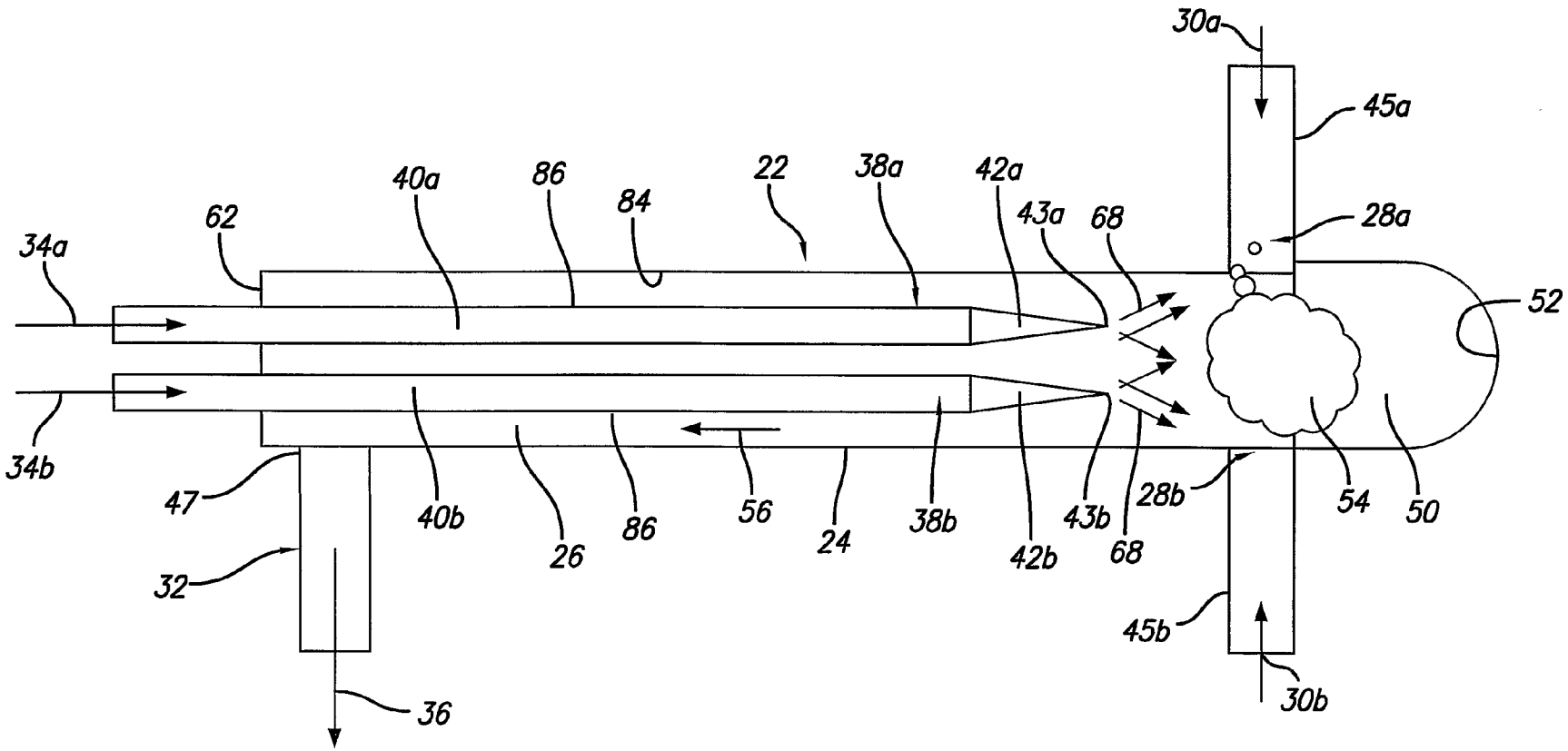
FIG. 3 is a diagrammatic illustration of an additional embodiment of the device employing multiple water inlets and multiple concentrate inlets.

With reference to FIG. 3, another embodiment of the device is disclosed. This embodiment of the device includes at least two water inlets 38*a*, 38*b* in the form of two tubes extending into the cavity and may include two or more concentrate inlets 28*a*, 28*b*. It should be noted that various combinations and configurations of multiple water inlets 38*a*, 38*b*, and a single concentrate inlet as well as a single water inlet and multiple concentrate inlets 28*a*, 28*b* may be provided. The one or more concentrate streams 30*a*, 30*b* may be introduced into the chamber 50 for subsequent mixing with water provided from the water inlets 38*a*, 38*b*. Of course, the details of the mixing of the concentrate and water is described in detail above. The combination of the water or other diluent with the concentrate occurs in a similar manner if not identical manner as described above except that there will be multiple concentrate streams of the same flavor, multiple flavors or multiple ingredients being introduced. The flow of water from the openings 43*a*, 43*b* of the dispensing ends 42*a*, 42*b* is generally non-coaxial.

It is envisioned that multiple water inlets 38*a*, 38*b* may be used to increase the mechanical combination or agitation of the water with a single stream of concentrate. Also it is envisioned that a single water inlet may be used to combine two different flavors or two identical flavors of concentrate flowing in through the multiple inlets 30*a*, 30*b*. With the foregoing in mind, there may be advantages to introducing smaller streams of identical concentrate flavors from two different directions so as to further result in combination with the dilution water.

Figure 4:
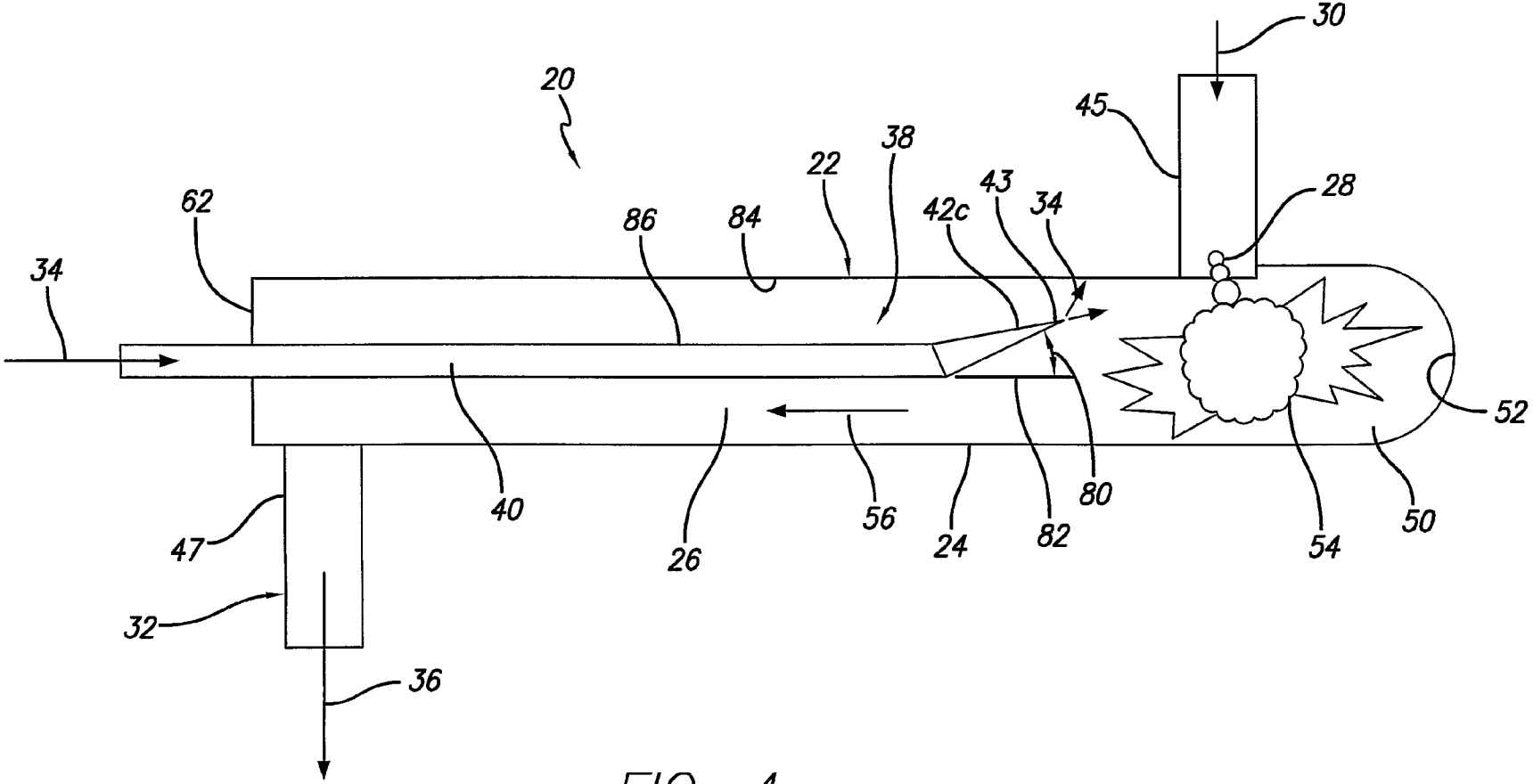
FIG. 4 is a diagrammatic illustration of an additional embodiment of the device employing a directional water inlet.
Figure 5:
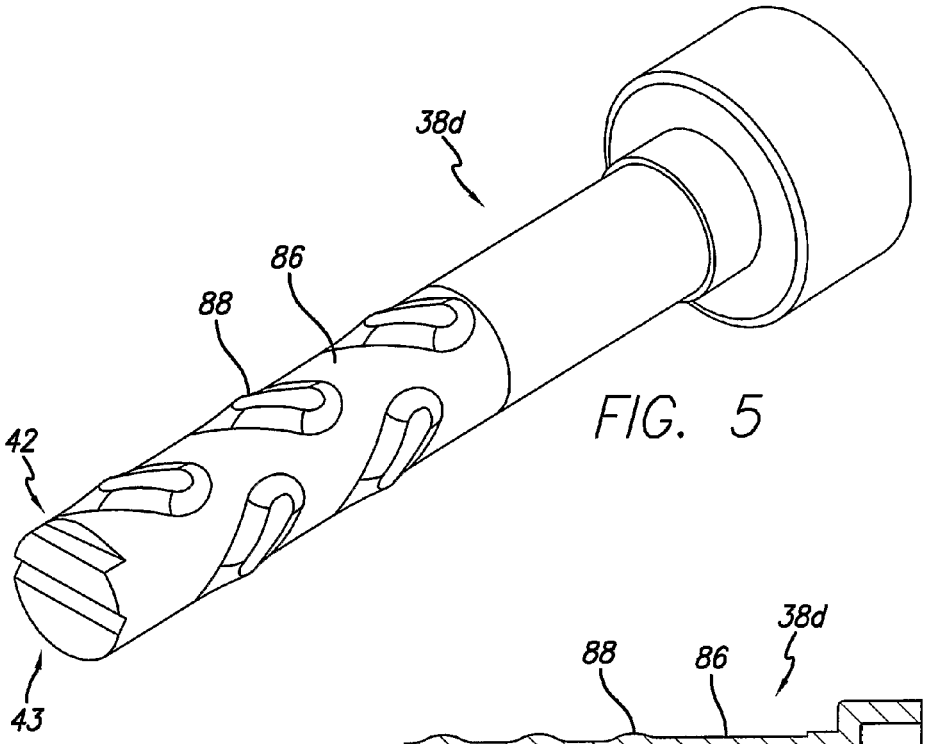
FIG. 5 is an enlarged perspective view of a water delivery inlet, including protrusions on the exterior surface of the inlet structure and multiple openings at a dispensing end.
Figure 6:
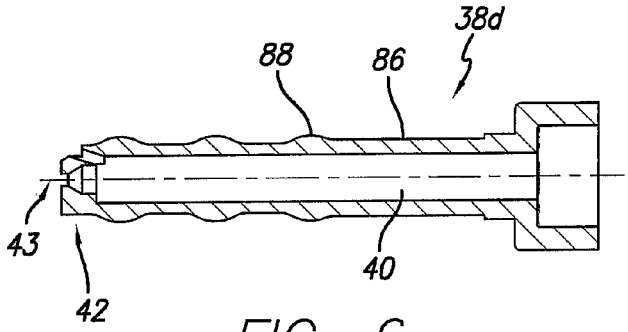
FIG. 6 is a cross-sectional side elevational view taken along line 6-6 in FIG. 5 showing the protrusions and the multiple openings.
Figure 7:
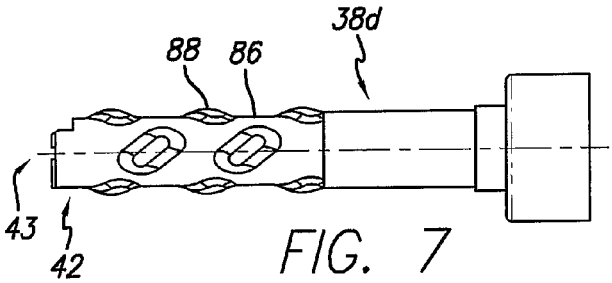
FIG. 7 is a side elevational view of the water delivery inlet shown in FIG. 5.

FIG. 4 is another embodiment of the device as disclosed. This embodiment of the device includes a water inlet 38*c* which includes a dispensing end or nozzle 42*c* which has been directed at an angle 80 in relation to a longitudinal axis 82. The nozzle 42*c* being angled (80) towards an inside surface 84 of the body 22. By having the jet 34*c* directed at an angle it deflects against the inside surface 84 to further enhance the mixing of the concentrate 54 introduced through the inlet 28. Generally, this will enhance the movement of the concentrate and water into the chamber 50 and improve mixing of the components. Additionally, by deflecting the nozzle 42*c* towards the inlet 28, a burst of water at the end of the dispensing cycle causes the water to clean the outlet 28. The configuration shown in FIG. 4 provides one embodiment of a self cleaning system. This system helps to remove left over juice pulp which might be included in the concentrate dispense from inlet 28. The angled deflection of the water jet caused by the angled nozzle 42*c* creates increased turbulence to further facilitate mixing.

FIGS. 5-8 show another embodiment of the inlet structure 38*d*. The inlet structure shown in FIGS. 5-8 can be substituted for the diagrammatic inlet structure 38, 38*c*, shown in FIGS. 1-4.

As shown in FIGURES in 5-8, an exterior surface 86 of the inlet 38*d* includes a series of protrusions 88. The protrusions as shown are in the form of ribs which are positioned generally spirally about the exterior surface 86. While ribs are shown it is intended that a broad interpretation of the protrusions 88 is included in this disclosure. The pattern of the ribs as shown provides the structures which interrupt or disrupt an otherwise generally smooth flow path along the exterior surface 86 of the inlet 38*d*. Additionally, similar protrusions can be added to the interior surface 84 of the body 22. The function of the protrusions whether on the exterior surface 86 of the inlet 38*d*, interior surface 84 of the body 22 or any combination of such structures is to disrupt and increase turbulence in the flow of the mixed concentrate and water as it flows from the chamber 50 towards the exit 42.

Figure 8:
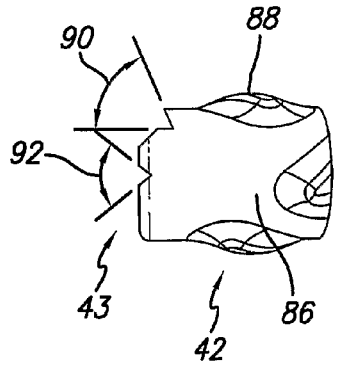
FIG. 8 is an enlarged partial fragmentary side view of the dispensing end showing the multiple openings.

Additionally, as shown in FIGS. 5-8 and more specifically in the enlarged partial fragmentary view of FIG. 8, the inlet 38*d* may include multiple openings at the dispensing end 43. First opening 90 and a second opening 92 may be formed on or near the dispensing end. Such multiple openings may be used to enhance the mixing and turbulence of the water as it is dispensed to mix with the concentrate.

Figure 9:
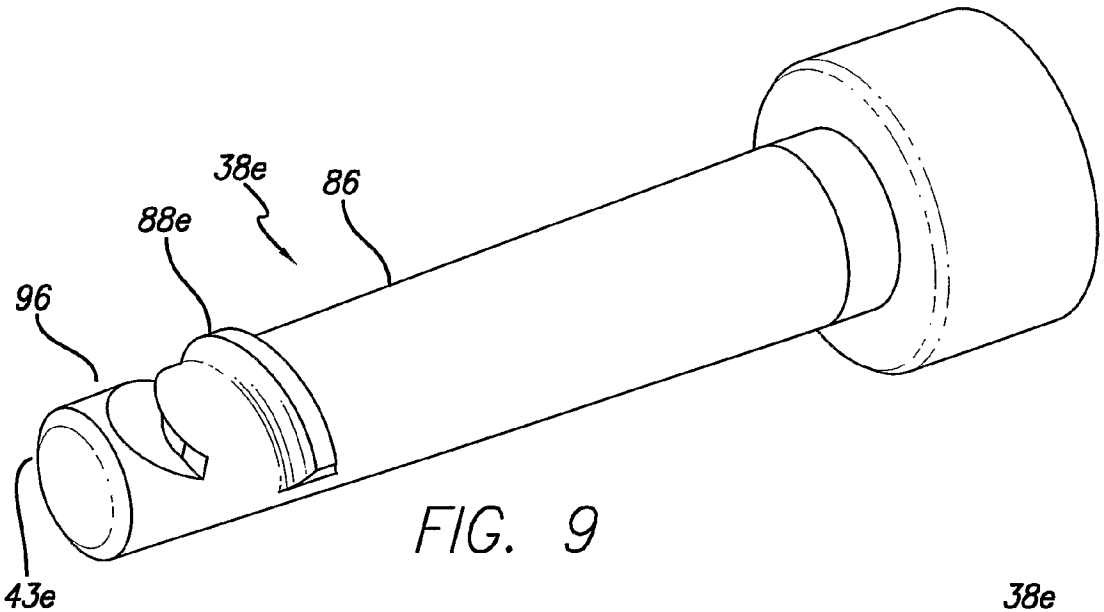
FIG. 9 is a perspective view of an additional embodiment of the water delivery inlet having a dispensing end with an angled opening and a protrusion spaced from the opening to resist movement of juice and to promote mixing.

In FIG. 9, another embodiment of the inlet 38*e* is shown. As shown in FIG. 9, the inlet 38*e* includes an opening 96 in the dispensing end 43*e*. The opening 96 is provided at an angle to provide the angled deflection benefits described herein above. Additionally as shown in FIG. 9, a protrusion 88*e* is positioned at least partially around a circumferential outer surface 86 of the inlet 38*e*. The circumferential protrusion 88*e* or dam is positioned spaced from the opening 96. The opening 96 is angled towards the inlet 28. The protrusion 88*e* in the form of a barrier or dam prevents bypassing of concentrate from the top side which might otherwise escape mixing in the water stream or jet. This configuration of the inlet 38*e* further enhances the mixing of the concentrate and water. A lower portion of the inlet exterior surface 86 does not include the protrusion 88*e* so as to allow mixed concentrate and water to flow away from the chamber 50.

It should also be noted that all of the aforementioned variations of the device, system and method as described hereinabove with regard to FIGS. 1 and 2 also apply to FIGS. 3-9 and all combinations and permutations of all of the disclosed embodiments are included in this specification. In other words, even though FIGS. 3-9 do not provide the control systems as describe in FIG. 1 or the cascading configuration as described in FIG. 2, these configurations and embodiments are intended to be included in FIGS. 3-9. As such, the embodiment as described hereinabove and shown in FIGS. 3-9 may include a cascading effect which introduces additional flavors, flavoring or sweeteners, essence or aromas as well as other constituent ingredients or components and other characteristics of the beverage. Additionally, the control systems as described with regard to FIG. 1 including the sensors and control valves may also be incorporated in the embodiments and described with regard to FIGS. 3-9 and as shown in FIGS. 3-9. As such all of the various combinations of the information disclosed herein are intended to be included within this disclosure and any subsequent rights generated from this disclosure.

Figure 10:
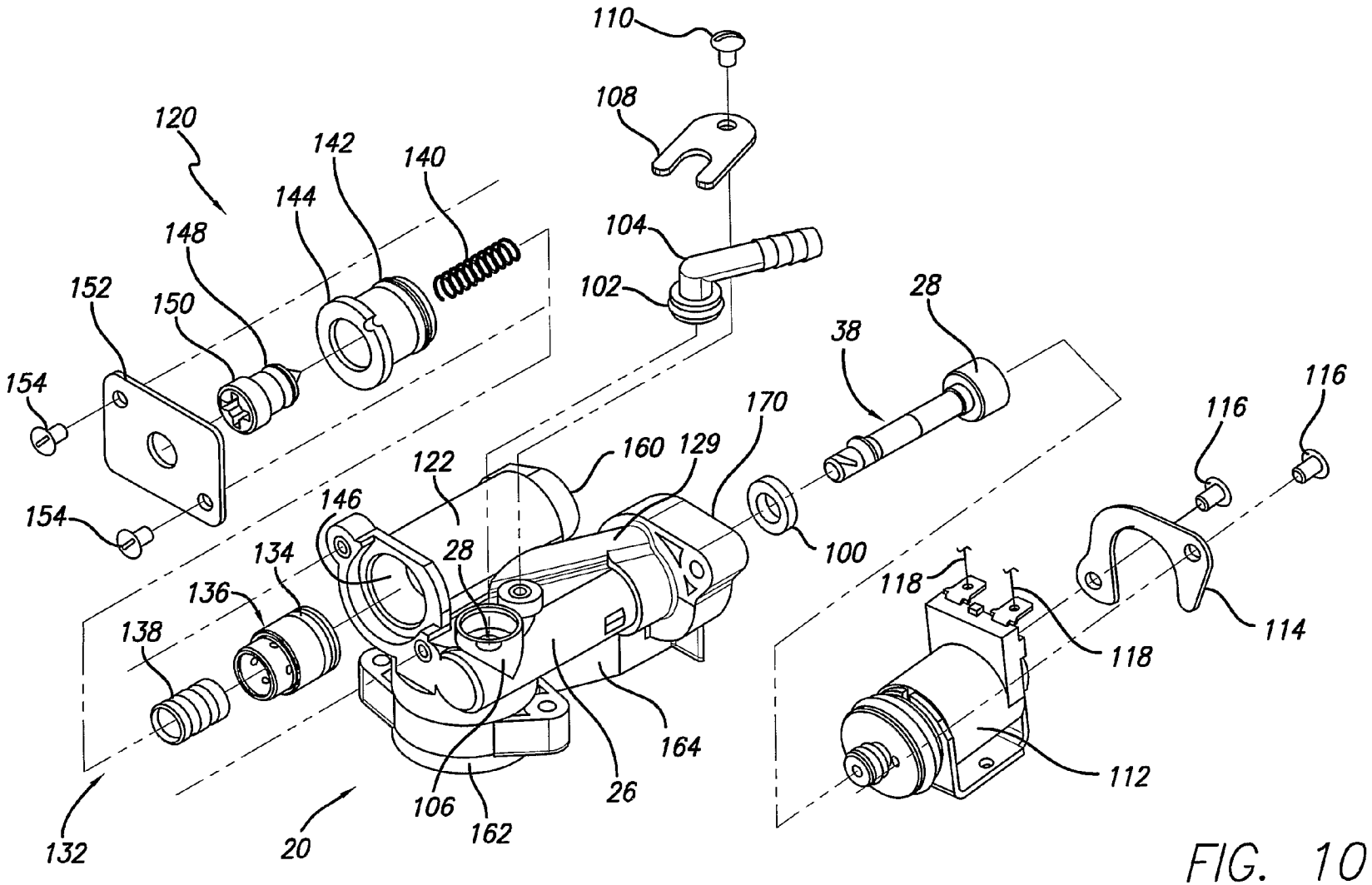
FIG. 10 is an exploded perspective view of an embodiment of the mixing device.

FIG. 10 is a perspective view of an embodiment of the mixing device 20. The mixing device includes the body 22 and the inlet 38. The inlet 38 is fitted to the body with a gasket 100. An O-ring 102 is attached to a fitting elbow 104 which couples to a fitting seat 106 on the body 22. The fitting 104 is retained on the body by means of a clamp 108 and screw 110.

A controllable valve 112 and inlet 38 are retained on the body 22 by a retaining clamp 114 and corresponding screws 116. Water is introduced into the body 22 through the water control fitting assembly 120. Water is introduced into a primary chamber 122 that communicates with a secondary chamber 124 that communicates with the inlet 38. Operation of the controllable valve 112 opens and closes against a rear portion 128 of the inlet 38 by means of moveable stopper 130. The inlet water assembly 120 is pressurized thereby allowing positive flow of water through the primary and secondary chambers 122, 124 when the valve 112 is operated over lines 118 by a controller.

The water inlet assembly 120 includes a flow control assembly 132. The flow control 132 assembly includes an O-ring 134 on a sleeve 136. A flow control piston 138 is retained in the sleeve. Flow control spring 140 acts against the piston 138. Another O-ring 142 is carried on an adjuster bonnet 144. The adjuster bonnet 144 is engaged in the bore 146 of the primary chamber 122. An O-ring 148 and positioned adjuster 150 is engaged with the bonnet 144 with the entire assembly being retained in place by a bracket 152 attached to the body with screws 154. Flow control assembly 132 allows for adjustment of the flow of the water attached to the feed side 160 of the primary chamber 122.

Figure 11:
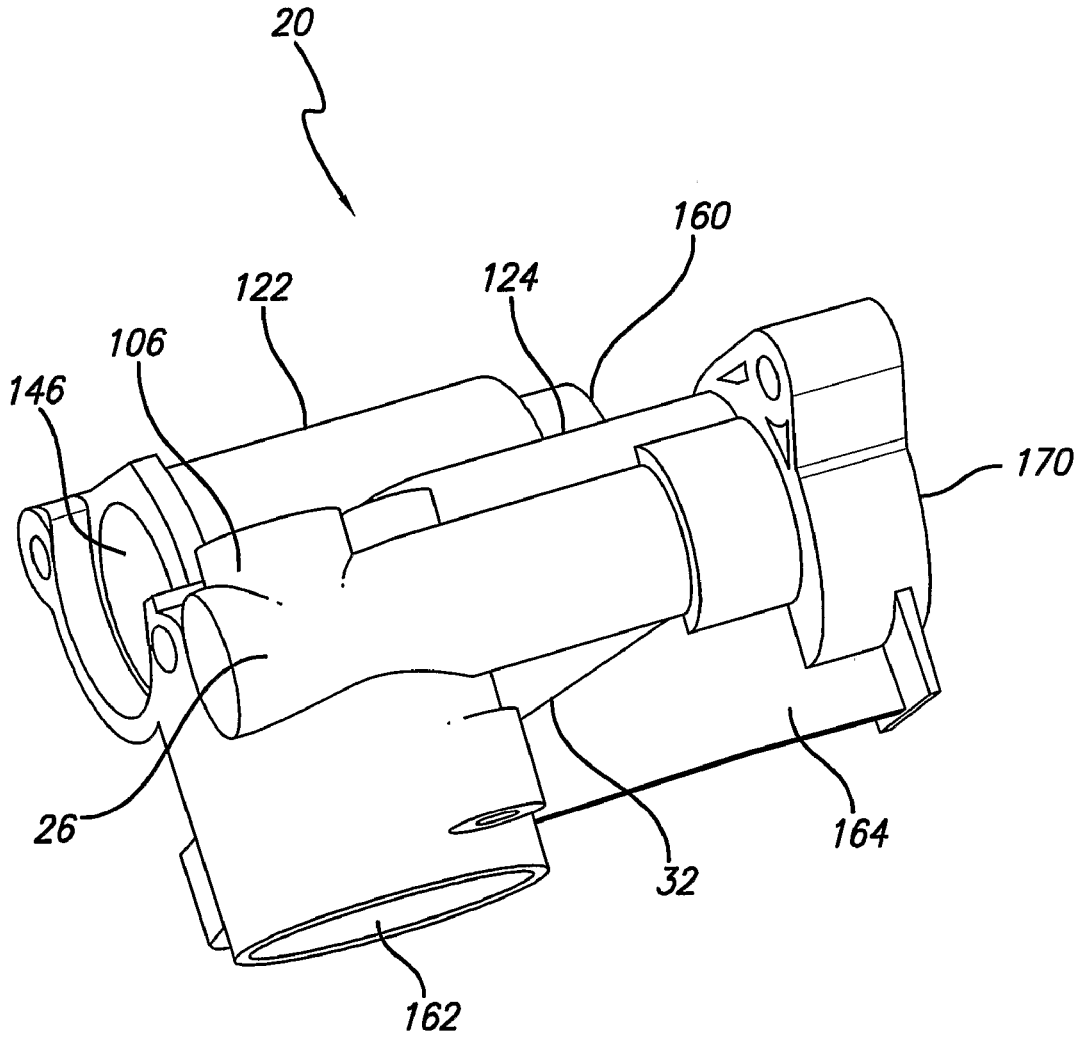
FIG. 11 is a side perspective view of an embodiment of a mixing device.

The structures as disclosed in FIG. 10 are also shown and clarified in FIGS. 11-14 which show the body 20 in different views. With reference to FIG. 11, the bore 146 is shown extending into the primary chamber 122. The outlet 32 from the cavity 26 leads to and communicates with a nozzle outlet 162. A nozzle or other columnating device may be attached to the nozzle outlet 162. A reinforcing rib 164 has been added to the structures to provide additional strength.

Figure 12:
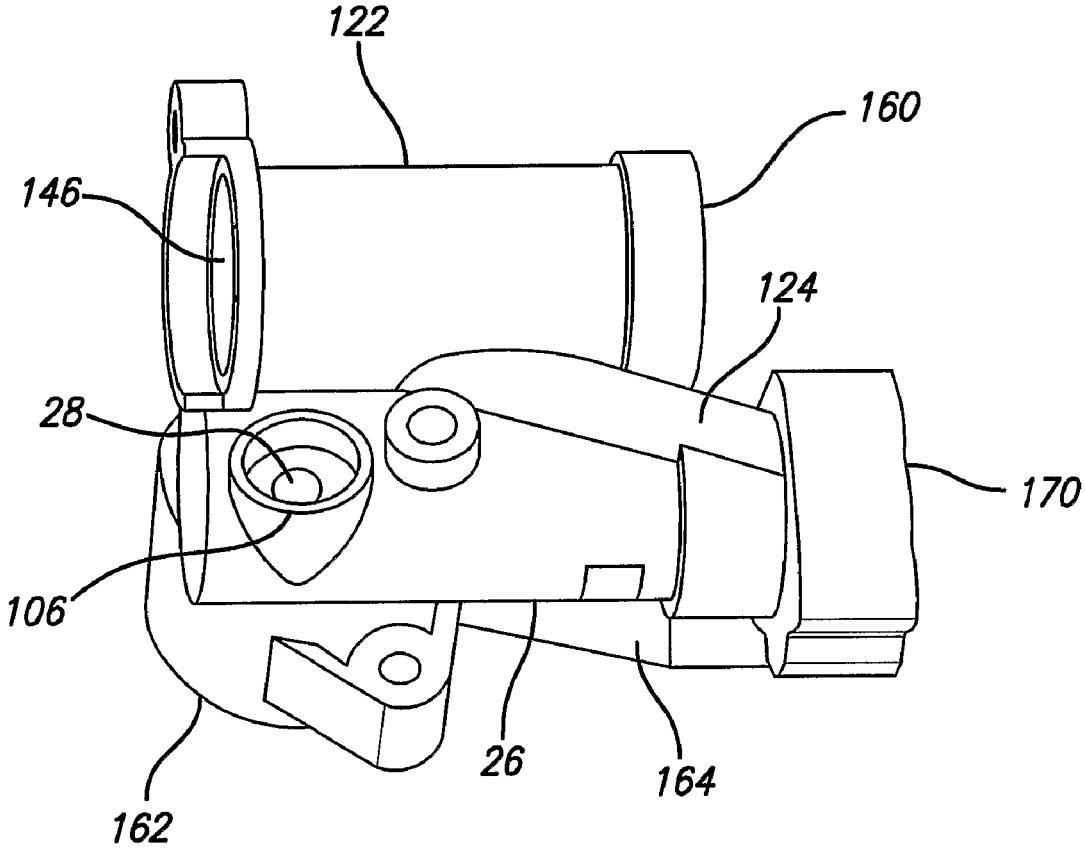
FIG. 12 is a top perspective view of the mixing device shown in FIG. 10.

FIG. 12 shows the primary chamber 122, secondary chamber 124 connecting to and communicating with the cavity 26. The concentrate seat 106 includes an inlet 28 through which is dispensed concentrate into the cavity 26.

Figure 13:
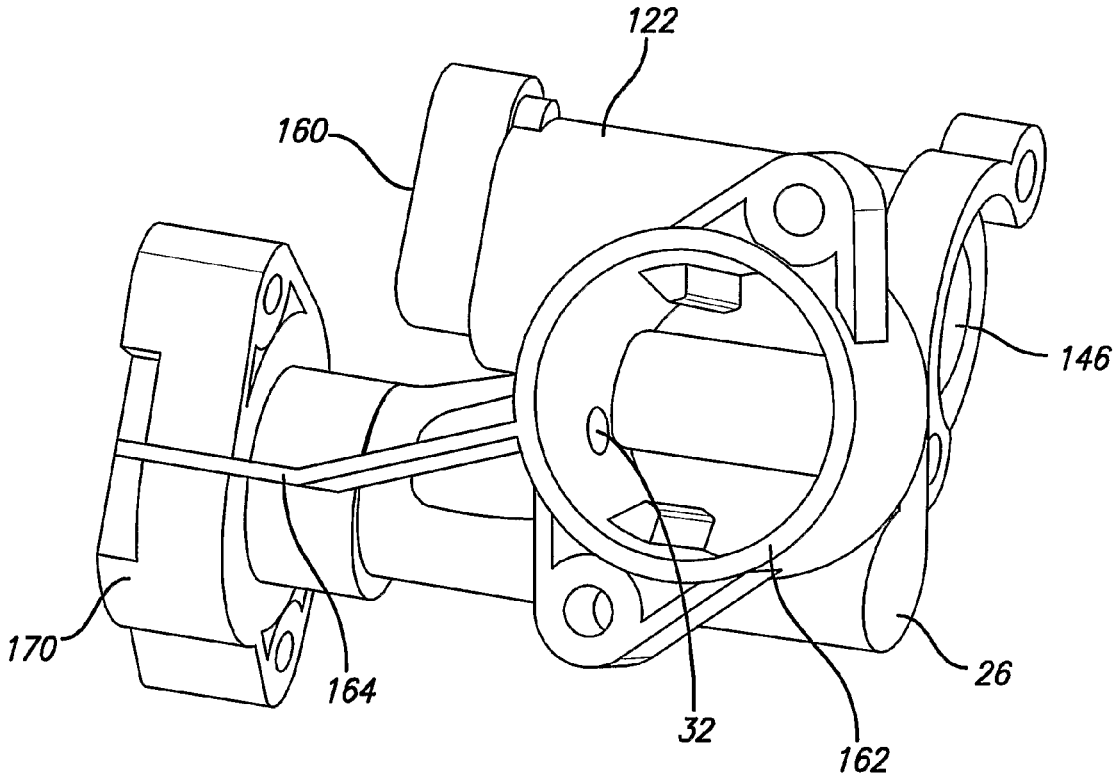
FIG. 13 is a bottom perspective view of the embodiment.

As shown in FIG. 13, the outlet 32 communicates with the nozzle 162. Also shown is the rib 164 providing structural support for the various structures described herein.

Figure 15:
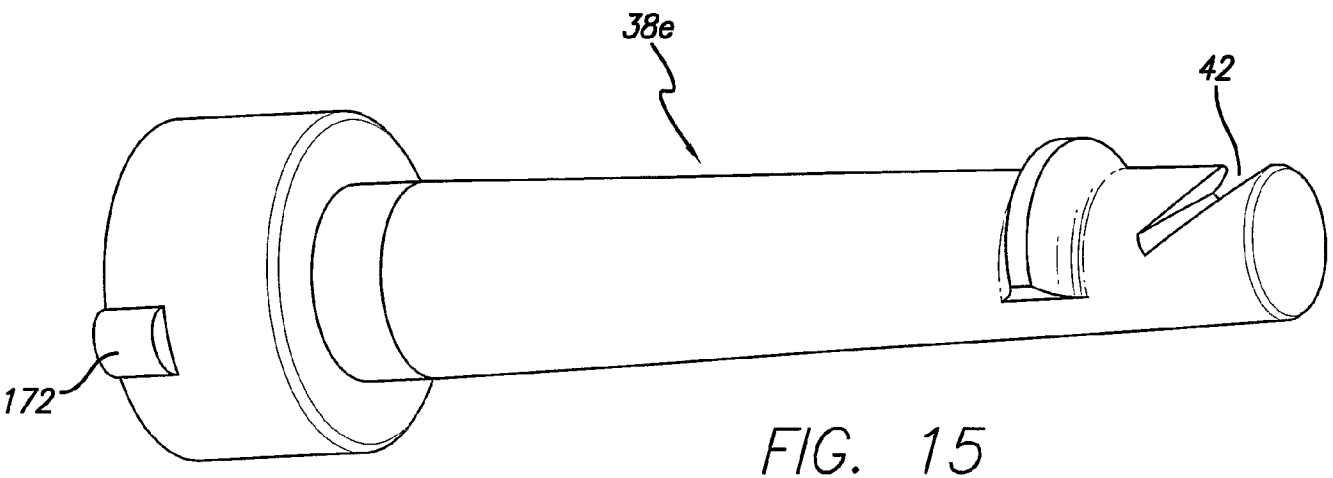
FIG. 15 is a side perspective view of a water inlet used in the body of the embodiment.
Figure 14:
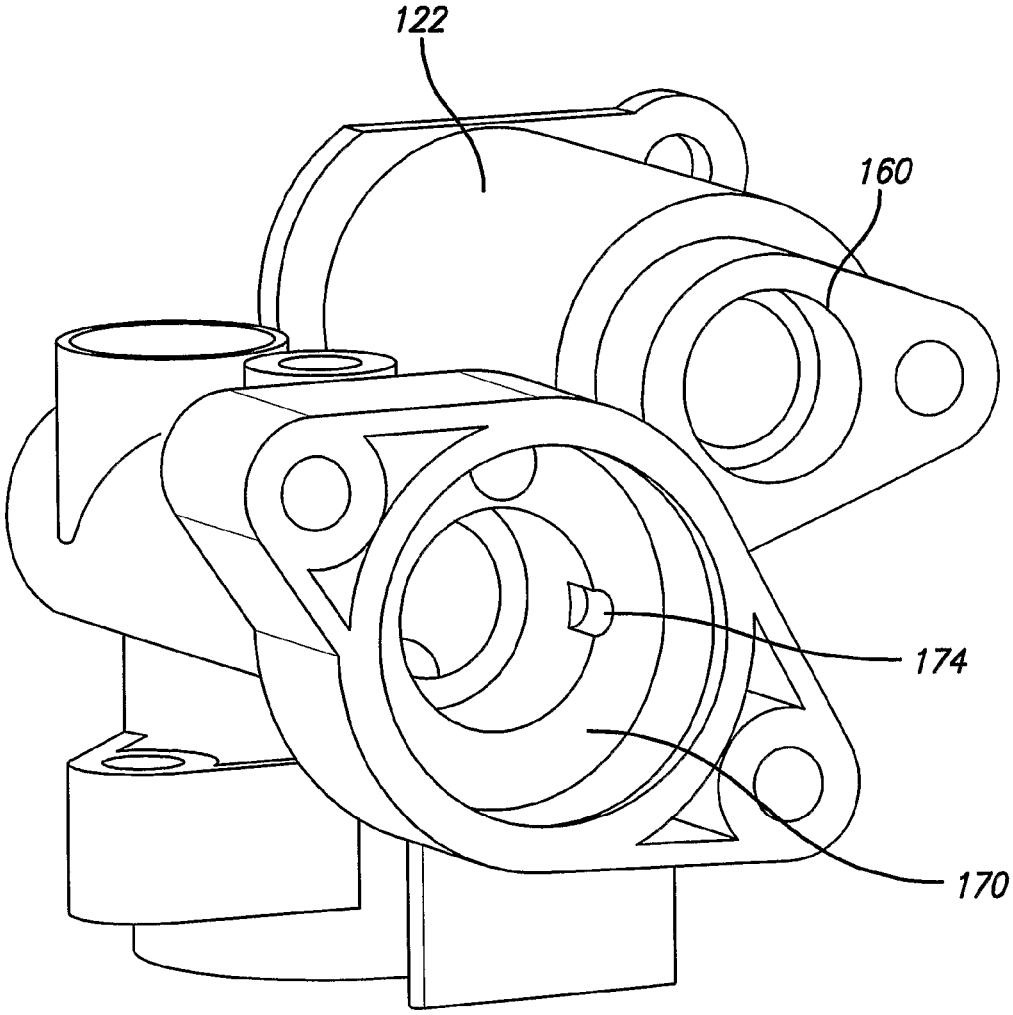
FIG. 14 is a rear perspective view of the embodiment.

As shown in FIG. 14, an opening or seat 170 is provided for receiving the outlet 38. The outlet 38 (see FIG. 15) includes a keyed structure 172 which is received in the keyed notch 174. This helps to properly orient the opening 43 of the inlet relative to the concentrate inlet 28. The pressurized water line is connected to the opening 160 for dispensing water into the primary chamber 122.

Figure 16:
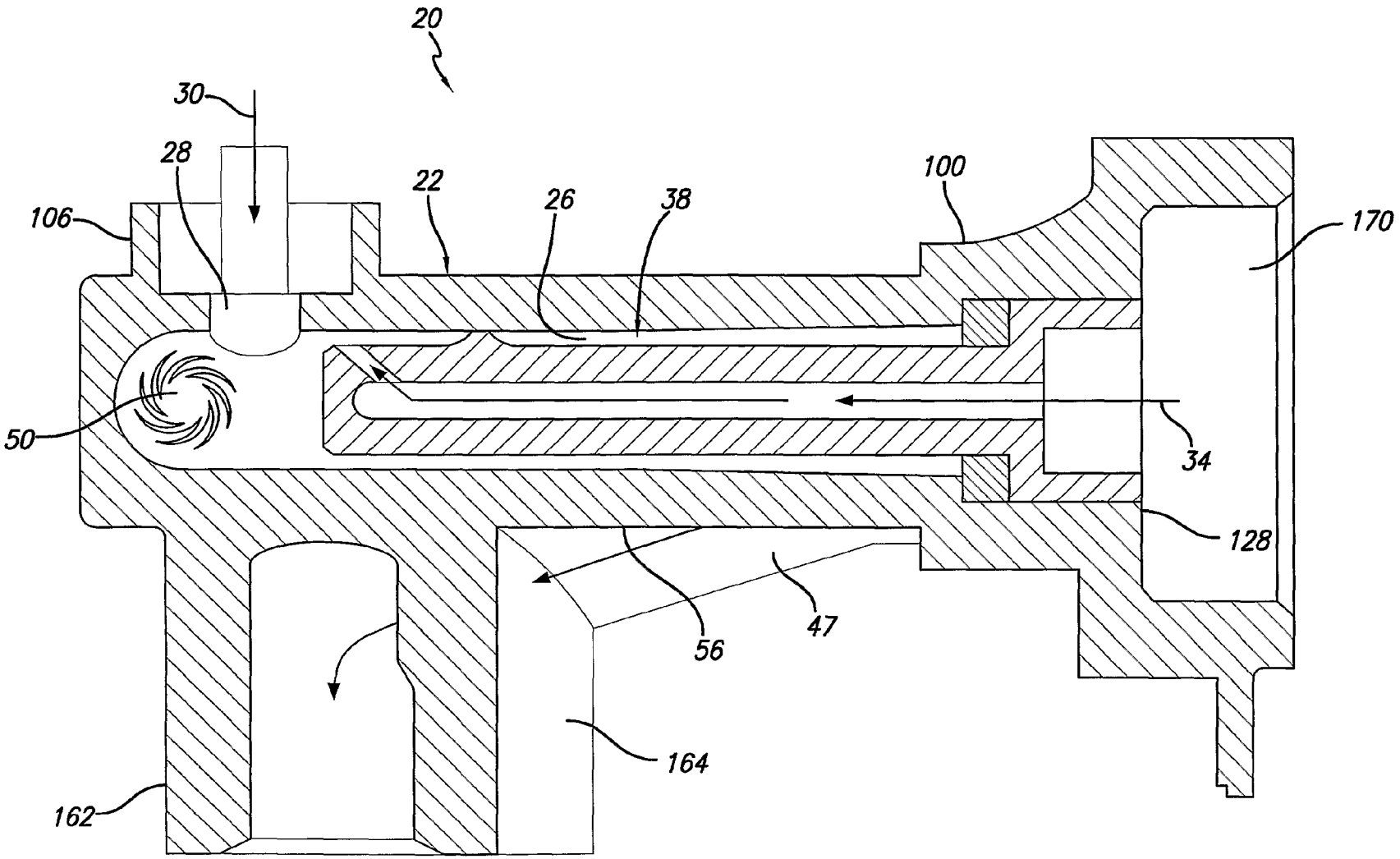
FIG. 16 is a partially fragmentary side elevational, cross-sectional view of a portion of the embodiment.

With further reference to FIG. 16, the inlet 38 is positioned generally coaxially in the cavity 26 for dispensing water 34 into the cavity 28. Concentrate 30 is dispensed through the concentrate inlet 28 for mixing with the water 34. Water and concentrate, or in other words a first ingredient and at least one second ingredient, are mixed in the chamber 50. After mixing as described in greater detail hereinabove, the mixture or product 56 of the at least two ingredients drains rearwardly through the chamber 26 toward the outlet tube 47. The outlet tube connects to the nozzle 162.

Figure 17:
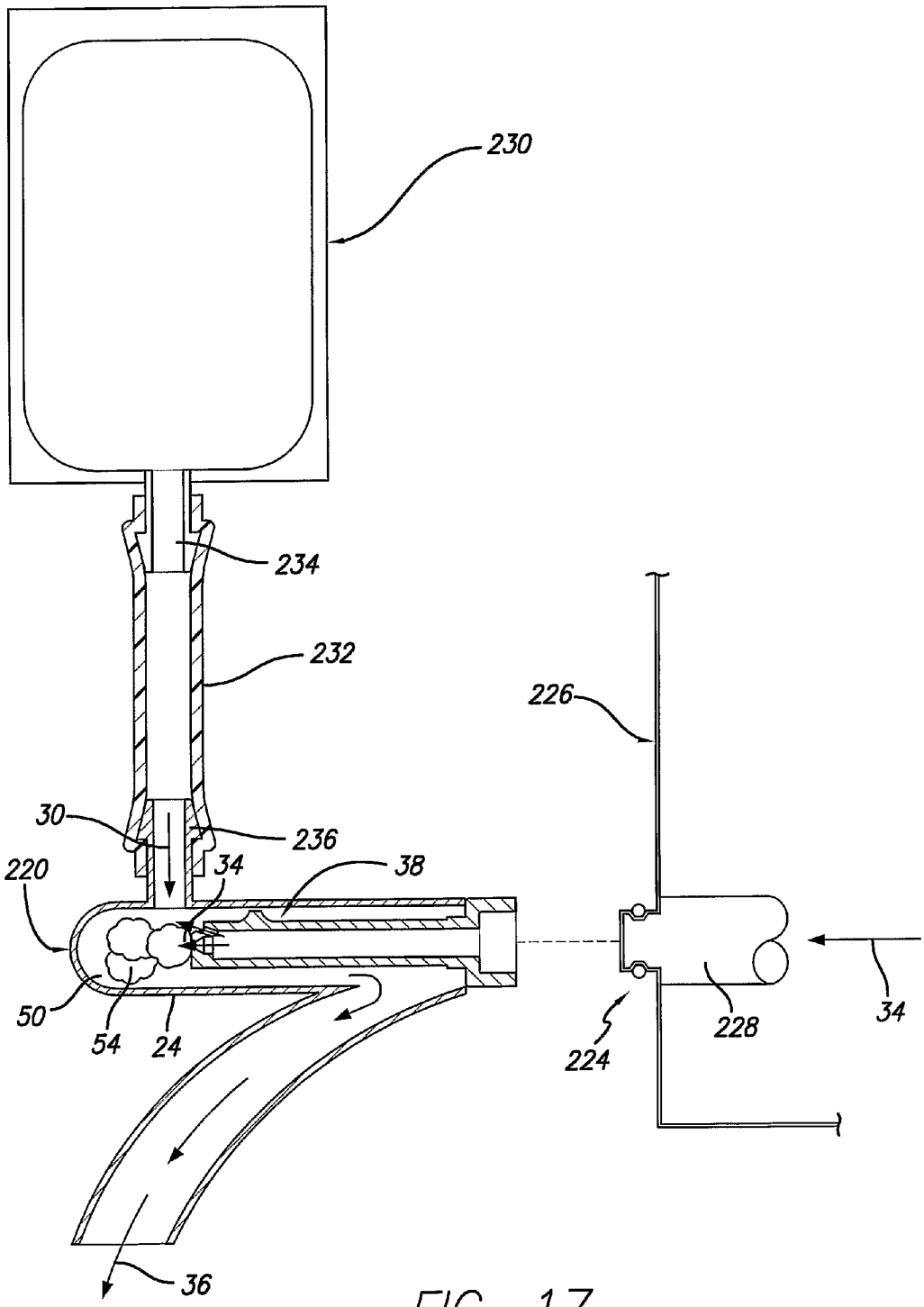
FIG. 17 is a diagrammatic side elevational, cross-sectional view of another embodiment of the mixing device.

As shown in FIG. 17, an embodiment of the mixing device 220 is shown which is developed and designed to be a disposable device or part of a retrofit kit. Generally the mixing device 220 is of the same configuration and operation as described above but is designed to be produced at low cost to facilitate a disposable operation. Also, this need not be disposable but may be used in a retrofitting application in which the overall design is sized and dimensioned for a universal application or for applications in specific pieces of dispensing equipment. In this embodiment, a diagrammatic illustration is provided to show a simplified version of the mixing device 220. Many other various, sizes, dimensions and proportions can be developed to achieve the same mixing results or similar mixing results as described herein above, all improving on the prior art. The kit may include one or more mixing device 220 and may include one or more tubes 232 for connecting mixing device 220 to a first ingredient source.

In the embodiment as shown in FIG. 17, a bayonet or quick fit connection 224 is provided on a machine 226. The machine includes a water line 228 with the quick disconnect fitting 224. Similarly, a first ingredient source in the form of a bag-in-box or "BIB" 230 is provided for coupling by a way of a tube 232 to the mixing device 220. Quick disconnect or barb fittings 234, 236 are provided on the BIB 230 and mixing device 220, respectively. In this embodiment, a retaining clamp or other device may used if there is need to secure the seat 170 of the mixing device 220 to the quick disconnect fitting 224 of the water line 228. The mixing device 220 can be provided as a quickly disconnectable, inexpensive part which may be thrown away after a period of uses, easily removed for washing or provided as a disposable component of a BIB 230 assembly which might include the BIB 230, tube 232 and mixing device 220.

In use, the user attaches the device 220 to the tube 232 and to the BIB 230. Additionally, the assembly may come preassembled with the tube 232 along with means for restricting or permitting flow through the tube. For example, the tube could be clamped shut during shipment whereupon a clamp is released from the tube 232 to allow flow through the tube. Additionally, while the tube 232 is shown as a rather short section, the tube can be an elongated section of a flexible tube which might be used in combination with a peristaltic pump or other pumping device. In this manner, the elongated tube can be installed or otherwise engaged with the pumping mechanism. This type of configuration will facilitate an easy and efficient installation in a sanitary manner. None of the structures or devices need to be opened and there is no contact between the concentrate retained within the BIB, tube and mixing device.

Figure 18:
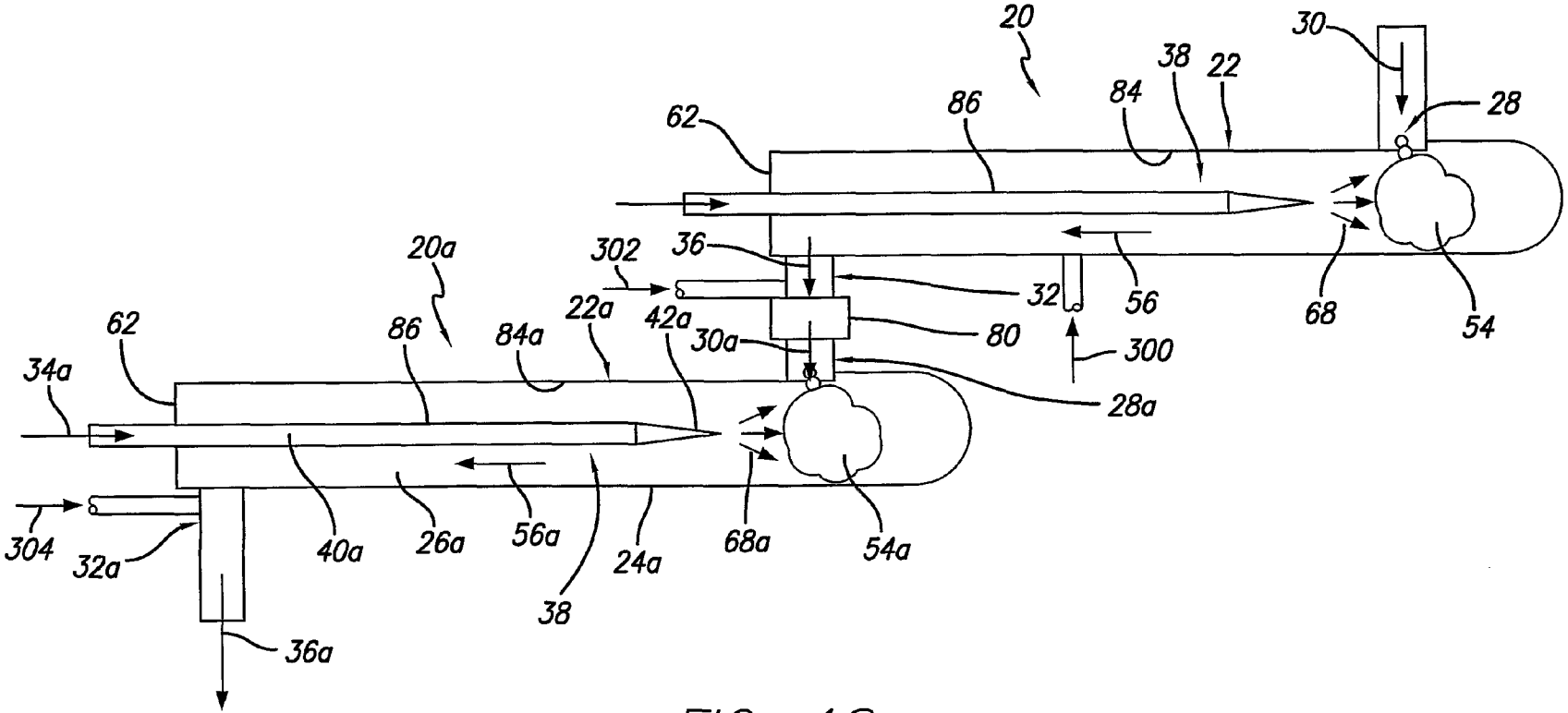
FIG. 18 is a diagrammatic view of the mixing device which is used to mix a multiple stage or multiple ingredient product similar to that as shown in FIG. 2.

With regard to FIG. 18, a mixing device similar to that as shown in FIG. 2 is provided. In FIG. 18, however, several inlet ports 300, 302, 304 are provided. These inlet ports are provided for the dispensing of an additional ingredient to a mixture of at least two ingredients. For example, when at least a first and second ingredient are mixed in the mixing device 20 to still be added at one or more of the inlet ports 300, 302. The third ingredient such as a distillate may be added. Additionally, distillate may be added to a second mixing device **20*a* which combines the product of the first mixing device 20 and an additional dilution ingredient 34*a***.

While three different inlet port locations are shown, 300, 302, 304, any number of inlet ports may be used, and any variety of locations may be used. The inlet ports 300, 302, 304 shown in FIG. 18 are provided by way of example and not in any way providing a limitation on the specification.

For example, the inlet ports, 300, 302, 304 may be used to inject or introduce a distillate to a mixture. For example, when a tea concentrate dispensing system tea concentrate 30 may be introduced into the chamber for mixing with water 68 to produce a tea product 54. However, additional dilution may be required and as such the product 54 can flow into a second mixing device **20*a*. Whereas the first mixing device 20 may have introduced a heated water or dilution material, the second mixing device 20*a* may introduce a cool or unheated water or dilution material. The product of the second mixing chamber 54*a* may be the final product or may be the final produce before introduction of a distillate. The distillate provides additional flavor, aroma, and other beverage characteristics which may not be found or may not be as prominently expressed in the concentrate or the dilution materials. As such, such a distillate may enhance the beverage experience. The introduction of the distillate may depend on such conditions such as the temperature of the beverage product or the timing of the beverage product as well as any number of additional conditions. As such, such inlet ports may be needed to be placed at any one or more locations throughout the dispensing process. All of the various locations of the inlet ports 300, 302, 304** and any other desired or preferred location is within the scope of this disclosure.

Further details of the configuration and operation of the apparatus, system and method disclosed herein can be found and related provisional applications entitled "Component Mixing Method, Apparatus and System" filed Jun. 25, 2004, U.S. Provisional Application No. 60/583,153, and related provisional application entitled "Component Mixing Method, Apparatus and System" filed Oct. 8, 2004, U.S. Provisional Application No. 60/617,106 and "Component Mixing Method, Apparatus and System" filed Mar. 11, 2005, U.S. Provisional Application No. 60/661,193.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the invention are desired to be protected. The applicants have provided description and figures which are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A mixing device for mixing at least one first ingredient and at least one second ingredient, the mixing device comprising:

a body defining a cavity;

at least one first inlet communicating with the cavity for delivering at least one first ingredient to the cavity;

at least one second inlet for communicating with the cavity for delivering at least one second ingredient;

at least one outlet communicating with the cavity for receiving the first ingredient and second ingredient mixed in the cavity; and a chamber defined in the cavity upstream from the outlet and from the direction of flow from the second inlet, the chamber positioned proximate to and receiving ingredients from at least the first inlet and the second inlet, ingredients mixed in the chamber moving through the cavity away from the chamber and the first and second inlets and towards the outlet.

2. The mixing device of claim 1, further comprising: a dispensing end of the second inlet positioned in the cavity generally between the first inlet and the outlet.

3. The mixing device of claim 2, wherein the dispensing end of the second inlet is positioned generally downstream of the first inlet and generally upstream of the outlet.

4. The mixing device of claim 1, wherein the second inlet is a passage positioned in the cavity extending between the outlet and the first inlet.

5. The mixing device of claim 1, wherein two second inlets are positioned in the cavity extending between the outlet and the first inlet.

6. The mixing device of claim 1, the second inlet defining a passage extending into the cavity, a dam provided on the passage positioned towards the dispensing end of the passage for restricting the flow of at least one of the two ingredients in the chamber and the cavity.

7. The mixing device of claim 1, the second inlet defining a passage extending into the cavity, at least one protrusion provided on an outside surface of the passage for increasing the mixing effect in the cavity between the passage and the corresponding cavity wall.

8. The mixing device of claim 1, the second inlet defining an inlet structure extending into the cavity, a dispensing end of the inlet structure having at least one opening for dispensing the at least one second ingredient there through.

9. The mixing device of claim 1, the second inlet defining an inlet structure extending into the cavity, a dispensing end of the inlet structure having a first opening and a second opening for dispensing the at least one second ingredient there through.

10. The mixing device of claim 9, wherein the first opening is positioned to produce a flow at an angle relative to the flow produced by the second opening.

11. The mixing device of claim 1, wherein the at least one second inlet is an inlet structure which is removably retained in the cavity.

12. A mixing device for mixing at least one first ingredient and at least one second ingredient, the mixing device comprising:

a body defining a cavity;

at least one first inlet communicating with the cavity for delivering at least one first ingredient to the cavity;

at least one second inlet for communicating with the cavity for introducing delivering at least one second ingredient;

a chamber defined in the cavity upstream from the direction of flow from the second inlet, the chamber positioned proximate to and receiving ingredients from the inlets;

an outlet spaced from the chamber and communicating with the cavity for receiving the mixed first and second ingredients;

a dispensing end of the second inlet positioned in the cavity generally between the first inlet and the outlet; and wherein flow from the first inlet is moved by the flow from the second inlet into the chamber for mixing in the chamber, ingredients mixed in the chamber moving through the cavity away from the chamber and the first and second inlets and towards the outlet.

13. The mixing device of claim 12, wherein the flow from the first inlet is mixed with the second inlet in the chamber until the mixture flows through the cavity past the first inlet and the second inlet toward the outlet.

14. A beverage dispensing apparatus for mixing ingredients to produce a beverage, the beverage dispensing apparatus including a mixing device for mixing at least one first ingredient and at least one second ingredient, the mixing device being attachable to multiple ingredient sources for mixing the ingredients in the mixing device, the mixing device comprising:

a body defining a cavity;

at least one first inlet selectively coupled to a corresponding first ingredient source and communicating with the cavity for delivering at least one first ingredient to the cavity;

at least one second inlet selectively coupled to a corresponding second ingredient source for communicating with the cavity for delivering at least one second ingredient;

a chamber defined in the cavity upstream from the direction of flow from the second inlet, the chamber positioned proximate to and receiving ingredients from the inlets;

an outlet spaced from the and communicating with the cavity for receiving the mixed first and second ingredients;

a dispensing end of the second inlet positioned in the cavity generally between the first inlet and the outlet; and wherein flow from the first and second inlets is moved into the chamber for mixing, ingredients mixed in the chamber moving through the cavity away from the chamber and the first and second inlets and towards the outlet.

15. A kit for use with a beverage dispenser, the kit providing a mixing device for installation in the beverage dispenser, the kit comprising:

at least one mixing device for mixing at least one first ingredient and at least one second ingredient, each mixing device having a body defining a cavity;

at least one first inlet communicating with the cavity for delivering at least one first ingredient to the cavity;

at least one second inlet for communicating with the cavity for delivering at least one second ingredient; and at least one outlet communicating with the cavity for receiving the mixed first ingredient and second ingredient;

a chamber defined in the cavity upstream from the direction of flow from the second inlet, the chamber positioned proximate to and receiving ingredients from the inlets;

wherein flow from the first and second inlets is moved into the chamber for mixing, ingredients mixed in the chamber moving through the cavity away from the chamber and the first and second inlets and towards the outlet.

16. The kit of claim 15 further comprising:

a tube for connecting the at least one first inlet with a first ingredient source.

17. The kit of claim 16, wherein at least one tube is provide in each kit for each mixing device provided in the kit.

18. A first ingredient source for supplying at least one ingredient to make a product, the ingredient source including a mixing device for mixing at least one first ingredient and at least one second ingredient, the mixing device being attachable to multiple ingredient sources for mixing the ingredients in the mixing device, the mixing device comprising:

a body defining a cavity;

at least one first inlet connected to the first ingredient source and communicating with the cavity for delivering at least one first ingredient to the cavity;

at least one second inlet selectively coupled to a corresponding second ingredient source for communicating with the cavity for delivering at least one second ingredient;

a chamber defined in the cavity upstream from the outlet and from the direction of flow from the second inlet, the chamber positioned proximate to and receiving ingredients from at least the first inlet and the second inlet, ingredients mixed in the chamber moving through the cavity away from the chamber and the first and second inlets;

an outlet spaced from the chamber and communicating with the cavity for receiving the mixed first and second ingredients; and a dispensing end of the second inlet positioned in the cavity generally between the first inlet and the outlet.

19. The first ingredient source of claim 18, the second inlet defines a seat for connection to a second ingredient source.

* * * * *